United States Patent [19]

Mathiesen

[11] Patent Number: 4,577,838

[45] Date of Patent: Mar. 25, 1986

[54] TREATMENT OF PELLETIZED IRON ORES

[75] Inventor: Mait M. Mathiesen, Arild, Sweden

[73] Assignee: Plasma Holdings, N.V., Minneapolis, Minn.

[21] Appl. No.: 621,882

[22] Filed: Jun. 18, 1984

Related U.S. Application Data

[63] Continuation of Ser. No. 458,565, Jan. 17, 1983, abandoned.

[51] Int. Cl.[4] ..... C22B 4/08

[52] U.S. Cl. ..... 266/171; 266/156; 75/5

[58] Field of Search ..... 75/3, 5, 34–37; 266/156, 168, 171, 176, 177

[56] References Cited

U.S. PATENT DOCUMENTS

| | | | |
|---|---|---|---|
| 3,314,780 | 4/1967 | Holowaty et al. | 75/5 |
| 3,776,533 | 12/1973 | Vlnaty | 75/3 |
| 3,853,536 | 12/1974 | Tylko | 75/3 |
| 4,362,554 | 12/1982 | Santen | 75/35 |
| 4,362,555 | 12/1982 | Santen et al. | 75/35 |

*Primary Examiner*—L. Dewayne Rutledge
*Assistant Examiner*—S. Kastler
*Attorney, Agent, or Firm*—Kinney & Lange

[57] ABSTRACT

A system for providing thermal and chemical energies for the production of pelletized iron ore concentrates while allowing a reduction of a portion of the material in process. The material in process is introduced as ore fines, pelletized and fired in an indurator to produce feedstock for reduction by further processing. A portion of the material in process is diverted to a reduction plant. The reduction plant provides thermal and chemical energies for the indurator. In a preferred embodiment, a low temperature plasma generator is employed, either as the reduction plant or to provide thermal and chemical energies for reduction. When a distinct reduction plant is employed, top gases from such plant may be supplied to the indurator to provide thermal and chemical energies therefor and to the plasma generator for recarburization thereof. The material in process may be diverted as ore fines or as fired or unfired pelletized ore concentrates.

4 Claims, 3 Drawing Figures

TREATMENT OF PELLETIZED IRON ORES

This application is a continuation of U.S. application Ser. No. 458,564 filed on January 17, 1983, now abandoned.

BACKGROUND OF THE INVENTION

The production of pelletized iron ore concentrates for reduction by further processing is known to the prior art. For example, taconite concentrates, available as finely comminuted and highly refractory powders, are commonly pelletized to meet the currently prevailing feedstock requirements of existing blast furnaces. The pelletizing process requires the formation and induration of pellets from ore powders or fines. This process, and particularly the induration process, consumes considerable quantities of energy.

Escalating costs for oil and/or natural gas have increased the interest in coal fired systems. A major problem in coal systems is the ash associated with coal firing and the fact that coal, with appropriate ash fusion characteristics, is relatively limited and expensive. Thus, studies have been undertaken to assess the suitability of separate coal gasification processes utilizing known techniques. It has been shown that the relatively low energy gas produced by these known processes is acceptable for powering known taconite pellet induration plants. However, known coal gasification techniques require large capital expenditures for plant construction.

Known taconite pelletizing systems produce a pelletized iron ore concentrate from a material which is introduced to the system as ore powders or fines. As noted above, the material in process is pelletized and fired in an indurator to produce a feedstock for reduction by further processing. Typically, this further processing is by a blast furnace at a location remote from the equipment forming the pelletizing system and the supply of ore fines itself. Indeed, pelletizing systems are typically located adjacent the supply of raw material to minimize transportation. However, the requirements for reduced metal at the location of the pelletizing operation requires shipment of the ore pellets for further processing and a return shipment of the reduced metal.

SUMMARY OF THE INVENTION

The present invention allows the continued large-scale production of pelletized ore concentrates in accordance with known techniques while allowing a diversion of a portion of the material in process for on-site reduction. On-site reduction, in accordance with the present invention, provides an economical source of thermal and chemical energies for induration plants of existing design. Thus, both energy and transportation considerations are addressed by the present invention.

Any existing induration plant (e.g., grate, crate-kiln, shaft, etc.) may be integrated with any type of reduction plant in accordance with the present invention. In preferred embodiments, a low temperature plasma reactor is employed to convert a solid fuel into a gaseous fuel and provide at least a significant portion of the thermal and chemical energies necessary for pellet induration. As required, an on-site reduction plant may be powered by the plasma reactor. Top gases from the reduction plant may also be employed to provide thermal and chemical energies for the pellet indurator. Alternatively, the plasma reactor may, itself, be employed for reduction with its effluent being directed to the indurator for the purposes discussed.

Many known low temperature plasma reactors may be advantageously employed in the practice of the present invention. However, varying efficiencies and abilities to entrain solid fuels in their effluents render some reactors preferable to others. A plasma reactor capable of high solids entrainment and high gasification rates is the sustained-shock-wave, low-temperature plasma reactor disclosed in U.S. application Ser. No. 138,693, filed Apr. 9, 1980, now U.S. Pat. No. 4,361,441, entitled "Treatment of Matter in Low Temperature Plasmas", which is commonly owned with the present invention and which is hereby incorporated by reference.

DETAILED DESCRIPTION OF THE DRAWINGS

Figure 1:
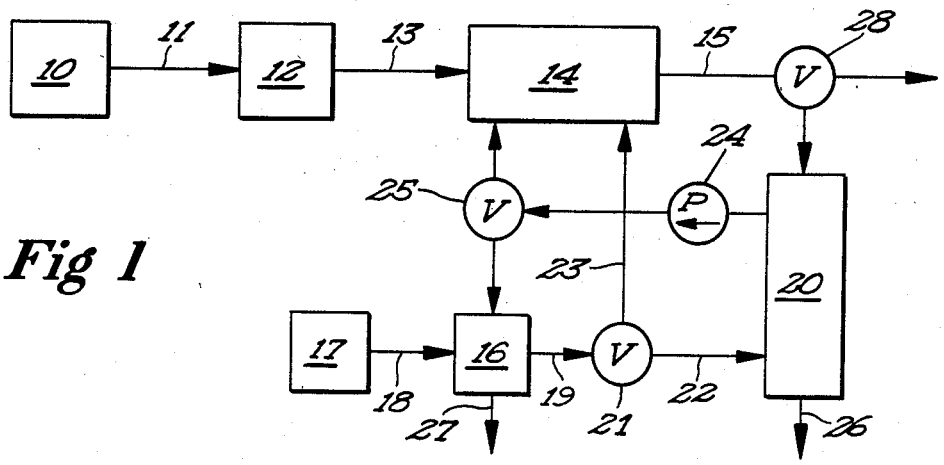
FIG. 1 schematically illustrates a preferred embodiment of the present invention.

Throughout the drawings, functionally similar or identical components are designated with the same reference numeral. For example, each of the drawings include a taconite pelletizing system formed of components designated by reference numerals 10–15. Reference numeral 10 represents a supply of ore fines which is delivered to a pelletizing plant 12 as represented by line 11. Pelleitzing plant 12 produces green or unfired pellets, in known manner, which are fed to an induration plant 14 as represented by line 13. Induration plant 14 produces fired pellets whose output, at line 15, may be shipped for further processing as by reduction in a blast furnace.

Components 10–15 may be of any known design and may be associated, in accordance with the present invention, with any type of reduction plant. In this manner, a large-scale production of indurated pellets may be continued, while a portion of the ore concentrates in process is diverted for on-site reduction. The material reduced on-site eliminates the need for shipment of pellets for further processing and reshipment of reduced metal for local requirements. For the on-site reduction, thermal and chemical energies are produced which may be selectively provided to the indurator 14 to at least partially address its high energy requirements and attendant high cost. In a preferred embodiment, thermal and chemical energies for on-site reduction are provided by a plasma reactor 16 which is preferably of a type capable of high solids entrainment and high gasification rates as is the reactor disclosed in the specification incorporated hereinabove. The reactor of the incorporated specification is capable of high ionization and rapid starting and stopping with good control characteristics. Essentially, any material that burns may be employed as a feedstock for the reactor of the incorporated specification, including peat, garbage, coal, wood chips, etc., all of which need to be pulverized prior to being fed to the reactor. It has been found that solid feedstocks of comminuted, carbonacious materials having individual particle sizes up to $\frac{1}{8}$ inch or more may be successfully employed within the reactor of the incorporated specification. The reactor feedstock is represented in the drawings at reference number 17 while the feeding of that feedstock to the reactor 16 is represented by the line 18. The reactor 16 converts the solid fuel feedstock into a gaseous fuel, the reactor of the incorporated specification having a high efficiency and the ability to entrain solid fuels in its effluent, the effluent being conducted via duct 19.

Figure 2:
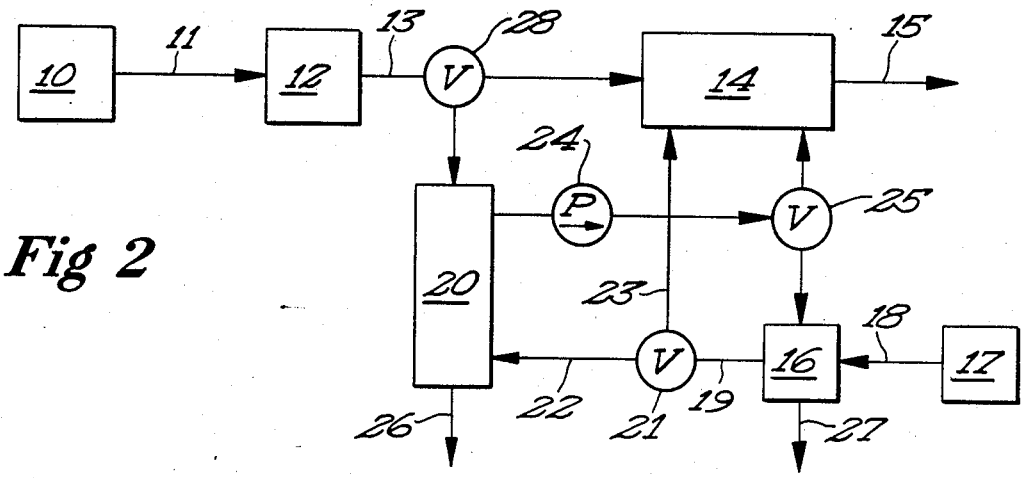
FIG. 2 schematically illustrates another preferred embodiment of the present invention.

The embodiments of FIGS. 1 and 2 employ a reduction plant 20 which may be of known design. Reduction plant 20 may be a direct reduction plant—a reduction plant other than a blast furnace. A valve 21 connected to the duct 19 selectively directs effluent from the reactor 16 to the reduction plant 20, via duct 22, and to the indurator 14, via duct 23.

As described to this point, the plasma reactor 16 converts solid fuel from the supply 17 to a gaseous fuel which is conducted, selectively via valve 21, to the reduction plant 20 and/or indurator 14 as plasma reactor effluents. Normally, the bulk of the reactor effluent will be conducted to the indurator 14 to continue a large-scale pelletizing operation. However, as local requirements for reduced metal dictate, reduction plant 20 may be powered, in known manner, by effluent from the plasma reactor 16 under the control of the valve 21. Local requirements for reduced metals may include the requirements for specialized steels which are easily satisfied by the present invention. Top gases from the reduction plant 20 may be withdrawn via a pump 24 to be selectively directed by a valve 25 to the indurator 14 for the provision of additional thermal and chemical energies therefor and/or to the plasma reactor 16 for recarburization therein, in known manner.

In the embodiment of FIG. 1, the feedstock to the reduction plant 20 is in the form of fired, pelletized ore concentrates drawn from the output 15 of the indurator 14 via valve 28. The embodiment of FIG. 2 is identical to that of FIG. 1, with the exception that the feedstock input to the reduction plant 20 is in the form of unfired, pellitized ore concentrates (green pellets) drawn from the output 13 of pelletizing 12 via valve 28. Reduced and metallized product from the reduction plants 20 are illustrated at 26 in FIGS. 1 and 2 while the solid or liquid output of plasma reactor 16 is illustrated at 27 in FIGS. 1 and 2.

Figure 3:
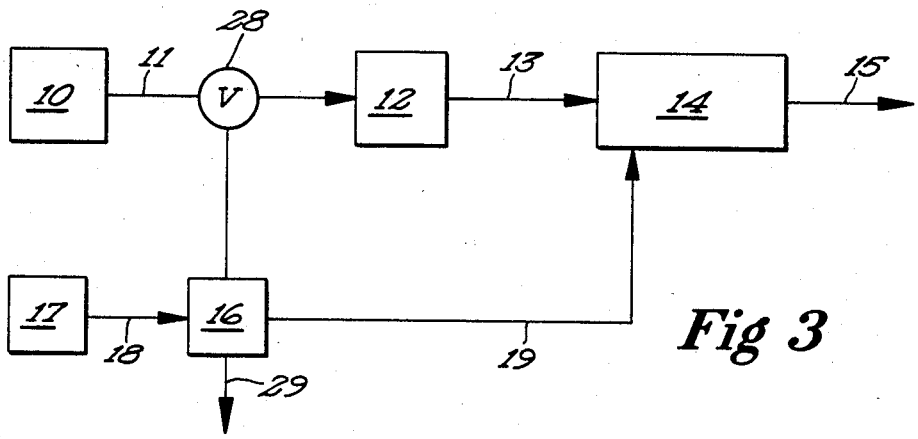
FIG. 3 illustrates a further preferred embodiment of the present invention.

Obviously, many modifications and variations of the present invention are possible in light of the above tachings. For example, FIG. 3 illustrates an alternative embodiment wherein the plasma reactor 16 functions as the reduction plant having, as an input, ore fines as fed to the pelletizing plant 12. In each of the illustrated embodiments, material in process in the pelletizing operation is diverted for reduction, either to the reduction plant 20 or plasma reactor 16, by a valve 28. Valve 28 allows a selection of the amount of material in process for reduction and/or pelletizing for further processing, in known manner. As disclosed in the incorporated specification, the output 29 of plasma reactor 16, as applied in the embodiment of FIG. 3, is a reduced and metallized product. Other modifications and variations will be apparent to those skilled in the art. It is therefore to be understood that, within the scope of the appended claims, the invention may be practiced otherwise than is specifically described.

What is claimed is:

1. Material processing apparatus for the production of pelletized iron ore concentrates of the type wherein the material is introduced for processing as ore fines, is pelletized and is fired in an indurator to produce feedstock for reduction by remote reducing means, the improvement which comprises:

low temperature plasma means;

on-site reduction plant means;

means for selectively diverting a portion of said material in process as fired, pelletized ore concentrates from the output of the indurator including a first valving mechanism to divert the ore concentrates to said on-site reduction plant means;

means suppling solid fuel to said low temperature plasma means for gasification thereby; and a second valving mechanism for selectively directing effluent from the plasma means to the on-site reduction plant means and to the indurator and for further selectively diverting effluent as needed from the on-site reduction plant means to the indurator.

2. Material processing apparatus for the production of pelletized iron ore concentrates of the type wherein the material is introduced for processing as ore fines, is pelletized in a pelletizer and is fired in an indurator to produce feedstock for reduction by remote reducing means, the improvement which comprises:

low temperature plasma means;

on-site reduction plant means;

means for selectively diverting a portion of said material in process as unfired, pelletized ore concentrates from the output of the pelletizer including a first valving mechanism to selectively divert the ore concentrates to said on-site reduction plant means;

means supplying solid fuel to said low temperature plasma means for gasification thereby; and a second valving mechanism for selectively directing plasma means effluent to said indurator and to said on-site reduction plant means for providing thermal and chemical energies thereof and for selectively further diverting effluent as needed from the on-site reduction plant means to the indurator.

3. The apparatus of claim 2 further comprising means selectively supplying direct reduction plant means top gases to said indurator to provide thermal and chemical energies therefor and to said plasma means for recarburization thereof.

4. Material processing apparatus for the production of pelletized iron ore concentrates of the type wherein the material is introduced for processing as ore fines, is pelletized and is fired in an indurator to produce feedstock for reduction by remote reducing means, the improvement which comprises:

on-site reducing means including low temperature plasma means;

means for selectively diverting a portion of said material in process to said plasma means for reducing portion of said material in process as ore fines including valving mechanism to divert the ore fines to the plasma means;

means supplying solid fuel to said on-site reducing means for gasification thereby; and means directing on-site reducing means effluent to said indurator for providing thermal and chemical energies therefor.

* * * * *